US007051549B2

(12) United States Patent
Kim et al.

(10) Patent No.: US 7,051,549 B2
(45) Date of Patent: May 30, 2006

(54) REFRIGERATOR

(75) Inventors: Sang-Bae Kim, Gyeongsangnam-Do (KR); Sang-Ho Park, Gyeongsangnam-Do (KR); Byeong-Gyu Kang, Gyeongsangnam-Do (KR); Youn-Chul Choi, Busan (KR)

(73) Assignee: LG Electronics Inc., Seoul (KR)

( * ) Notice: Subject to any disclaimer, the term of this patent is extended or adjusted under 35 U.S.C. 154(b) by 56 days.

(21) Appl. No.: 10/725,011

(22) Filed: Dec. 2, 2003

(65) Prior Publication Data

US 2004/0107726 A1 Jun. 10, 2004

(30) Foreign Application Priority Data

| | | |
|---|---|---|
| Dec. 6, 2002 | (KR) | 10-2002-0077423 |
| Dec. 6, 2002 | (KR) | 10-2002-0077426 |
| Dec. 6, 2002 | (KR) | 10-2002-0077427 |
| Dec. 6, 2002 | (KR) | 10-2002-0077428 |
| Dec. 6, 2002 | (KR) | 10-2002-0077429 |
| Dec. 6, 2002 | (KR) | 10-2002-0077430 |

(51) Int. Cl.
*F25B 29/00* (2006.01)
*F25D 17/04* (2006.01)
*F25D 11/02* (2006.01)

(52) U.S. Cl. ..... 62/441; 62/408; 62/159

(58) Field of Classification Search ..... 62/441, 62/408, 159, 407, 411, 452
See application file for complete search history.

(56) References Cited

U.S. PATENT DOCUMENTS 4,732,009 A * 3/1988 Frohbieter ..... 62/89
6,802,369 B1 * 10/2004 Zentner et al. ..... 165/267

FOREIGN PATENT DOCUMENTS

JP 06265291 A * 9/1994

* cited by examiner

*Primary Examiner*—Chen Wen Jiang
(74) *Attorney, Agent, or Firm*—Fleshner & Kim, LLP

(57) ABSTRACT

A refrigerator is provided which includes a variable temperature storage formed in the chilling chamber; a heating room formed on a side of the variable temperature storage; a heating device installed in the heating room and configured to generate heat; a first local circulating path in which cool air in the freezing chamber flows into a rear path through the variable temperature storage; an adjusting device configured to adjust a quantity of cool air flowing into/out of the variable temperature storage through the first local circulating path; a second local circulating path in which heated air in the heating room passes the variable temperature storage and flows into the heating room again; and a temperature sensor configured to sense a temperature in the variable temperature storage. Because various ranges of temperature can be maintained in the refrigerator, it is possible to perform optimum-temperature storing according to various kinds of foods. Accordingly, various kinds of foods can be stored freshly for a longer time.

27 Claims, 12 Drawing Sheets

REFRIGERATOR

BACKGROUND OF THE INVENTION

1. Field of the Invention

The present invention relates to a refrigerator, and in particular to a refrigerator capable of storing food freshly for a longer time and improving conveniency of life by storing food at an optimum storing temperature according to kinds of foods.

2. Description of the Related Art

In general, in a refrigerator, a refrigerating cycle system is installed, cool air is generated in an evaporator, the cool air maintains a freezing chamber and a chilling chamber in a cool state while circulating the freezing and the chilling chambers. Accordingly, a user stores food in the freezing and the chilling chambers to preserve the food for a long time.

The refrigerator can be classified into various types according to cool air circulating methods, positions of freezing and chilling chambers and constructions of an evaporator.

FIG. 1 is a perspective view illustrating an example of a general refrigerator, FIG. 2 is a side-sectional view illustrating a chilling chamber of the refrigerator, and FIG. 3 is a side-sectional view illustrating a freezing chamber of the refrigerator.

As depicted in FIGS. 1~3, in the refrigerator, a partition wall 110 is formed in a main body 100 in the up and down direction, a freezing chamber 120 and a chilling chamber 130 are respectively formed on the left and the right of the partition wall 110. A freezing chamber door 200 for opening/closing the freezing chamber 120 is combined with a side of the main body 100, and a chilling chamber door 300 for opening/closing a chilling chamber 130 is combined with the other side of the main body 100. In more detail, the freezing chamber door 200 and the chilling chamber door 300 are rotatively combined with both sides of the main body 100 respectively.

A rear path 140 in which cool air circulates is formed in the rear wall of the freezing chamber 120, and an evaporator 400 for generating cool air is installed in the rear path 140. Plural cool air discharge holes 141 for discharging cool air into the freezing chamber 120 are formed on the rear wall of the freezing chamber 120, and the cool air discharge holes 141 are connected with the rear path 140. An outflow through hole 142 for passing cool air through the freezing chamber 120 into the rear path 140 is formed at a lower region of the freezing chamber 120. And, shelves 150 on which food is mounted are inserted into the freezing chamber 120 at regular intervals.

A duct 160 is installed on the inner top portion of the chilling chamber 130, and an inflow through hole 111 for passing cool air generated in the evaporator 400 into the duct 160 is formed on the top region of the partition wall 110. A first damper 161 for adjusting a quantity of cool air flowing into the inflow through hole 111 is installed in the duct 160, and cool air discharge holes 162, 163 for discharging cool air into the chilling chamber 130 are respectively formed on the front and bottom of the duct 160. Shelves 151 on which food is mounted are inserted into the chilling chamber 130 at regular intervals, and a vegetable storage 170 for storing vegetables or fruits is formed in a lower region of the chilling chamber 130.

An outflow through hole 143 connected to the rear path 140 is formed at a lower region of the partition wall 110 in order to make cool air circulating the chilling chamber 130 flow to the evaporator 400.

A machine room 180 is formed on the lower rear region of the main body 100, and a compressor 500, etc. is installed in the machine room 180, A main fan 440 is installed at a side of the evaporator 400 in order to circulate cool air heat-exchanged in the evaporator 400, and a defrosting heater 410 for eliminating frost periodically is installed on the evaporator 400. And, a defrost water tray 420 in which defrost water stays is installed at a lower portion of the evaporator 400, and a defrost water distributing pipe 430 for guiding defrost water to the machine room 500 is connected to the bottom of the defrost water tray 420.

Reference numerals 210 are shelves formed on the freezing chamber door 200, reference numerals 310 are shelves formed on the chilling chamber door 300, and reference numeral 190 is an icemaker or an additional freezing storage.

The operation of the refrigerator will be described.

First, when the compressor 500 is operated, the evaporator 400 absorbs outside heat and generates cool air. Simultaneously, when the main fan 440 is rotated, cool air generated in the evaporator 400 flows through the rear path 140.

Cool air flowing through the rear path 140 is discharged into the freezing chamber 120 through the cool air discharge holes 141, and the cool air discharged into the freezing chamber 120 flows into the freezing chamber 120. Cool air flowing in the freezing chamber 120 flows into the rear path 140 through the outflow through hole 142 formed at the lower portion of the freezing chamber 120, and the cool air in the rear path 140 is heat-exchanged while passing the evaporator 400. The heat-exchanged cool air flows again into the freezing chamber 120 through the cool air discharge holes 141. By continuing the cool air circulating process, the freezing chamber 120 can maintain a cool state.

And, part of the cool air flowing through the evaporator 400 and the rear path 140 flows into the duct 160 through the inflow through hole 111 on the chilling chamber 130 by the operation of the first damper 161, and cool air in the duct 160 flows into the chilling chamber 130 through the cool air discharge holes 162, 163. The cool air in the chilling chamber 130 flows in the chilling chamber 130 and the vegetable storage 170 formed in the lower region of the chilling chamber 130, afterward, the cool air flows into the rear path 140 through the outflow through hole 143. The cool air is heat-exchanged while passing the evaporator 400 with the cool air through the freezing chamber 120. Part of the cool air passing the evaporator 400 flows into the duct 160 by the operation of the first damper 161, and it flows into the chilling chamber 130 again through the cool air discharge holes 162, 163. By continuing the cool air circulating process, the chilling chamber 130 can maintain a cool state.

In the meantime, while the cool air circulates along the evaporator 400, the freezing chamber 120, and the chilling chamber 130, moisture contained in food stored in the freezing chamber 120 and the chilling chamber 130 is evaporated and flows together with the cool air, it stays on the cold evaporator 400, and accordingly frost is generated on the evaporator 400. Because frost lowers efficiency of the evaporator 400, defrosting is periodically performed by operating the defrost heater 410. Herein, the operation of the compressor 500 and the main fan 440 is stopped. Defrost water is discharged to the machine room 180 through the defrost water tray 420 and the defrost water distributing pipe 430 arranged on the bottom of the evaporator 400.

Generally various foods can be stored in the refrigerator. Optimum storing temperature at which food can be stored freshly for a longer time is different according to kinds of foods, when an optimum storing temperature is not maintained, preservation term of food is reduced, and freshness of the food is easily lowered. On the contrary, when an optimum storing temperature is maintained, food can be freshly maintained for a longer time.

However, the conventional refrigerator includes the freezing chamber 120, the chilling chamber 130, and the vegetable storage 170. Because cool air maintains a set temperature state while circulating through the freezing chamber 120, the chilling chamber 130, and the vegetable storage 170, it is appropriate for storing frozen food or food not sensitive to a temperature; however, it is insufficient to store vegetables or fruits, etc. so as to be fresh for a long time. For example, in case of the vegetable storage, a certain temperature range (generally 2° C.~4° C.) is maintained by cool air flowing into the chilling chamber 130. However, because subtropical or tropical fruits such as banana, pineapple, mango, papaya, etc., or vegetables such as cabbage, spinach, parsley, tomato, cucumber, pumpkin, strawberry, pitch, grapes, etc. have a storing temperature within the range of 7° C.~10° C., when they are stored in the vegetable storage, preservation term of food (in which food is stored freshly) may be reduced.

In addition, in the conventional refrigerator, fish or meat, etc. is generally stored in the freezing chamber 120, in order to thaw frozen fish or meat, lots of time is required, it is inconvenient for a user. In addition, in case of storing meat, etc. for a short time, there is no appropriate storing region.

And, in the conventional refrigerator, in performing of the defrosting operation for removing frost on the evaporator 400, the compressor 500 and the main fan 440 are stopped, the defrost heater 410 is heated, defrosting time is comparatively increased, and accordingly temperature control in the freezing chamber 120, the chilling chamber 130 and the vegetable storage 170 can not be performed accurately for the defrosting operation time.

SUMMARY OF THE INVENTION

In order to solve the above-mentioned problem, it is an object of the present invention to provide a refrigerator capable of storing food freshly for a longer time and improving conveniency of life by storing food at an optimum storing temperature according to kinds of foods.

In order to achieve the above-mentioned object, in a refrigerator including a refrigerator main body having a freezing chamber and a chilling chamber in which foods are stored, a machine room in which a compressor is installed and a rear path in which cool air generated in an evaporator flows into the freezing chamber and the chilling chamber and flows back into the evaporator; and doors respectively combined with the refrigerator main body so as to open/close the freezing chamber and the chilling chamber, a refrigerator in accordance with the present invention includes a variable temperature storage formed in the chilling chamber so as to have a certain space; a heating room formed on a side of the variable temperature storage; a heating means installed in the heating room in order to generate heat in power supply; a first local circulating path in which cool air in the freezing chamber flows into a rear path through the variable temperature storage; an adjusting means for adjusting a quantity of cool air flowing into/out of the variable temperature storage through the first local circulating path; a second local circulating path in which heated air in the heating room passes the variable temperature storage and flows into the heating room again; and a temperature sensor for sensing a temperature in the variable temperature storage.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiments of the present invention will be described with reference to accompanying drawings.

Figure 1:
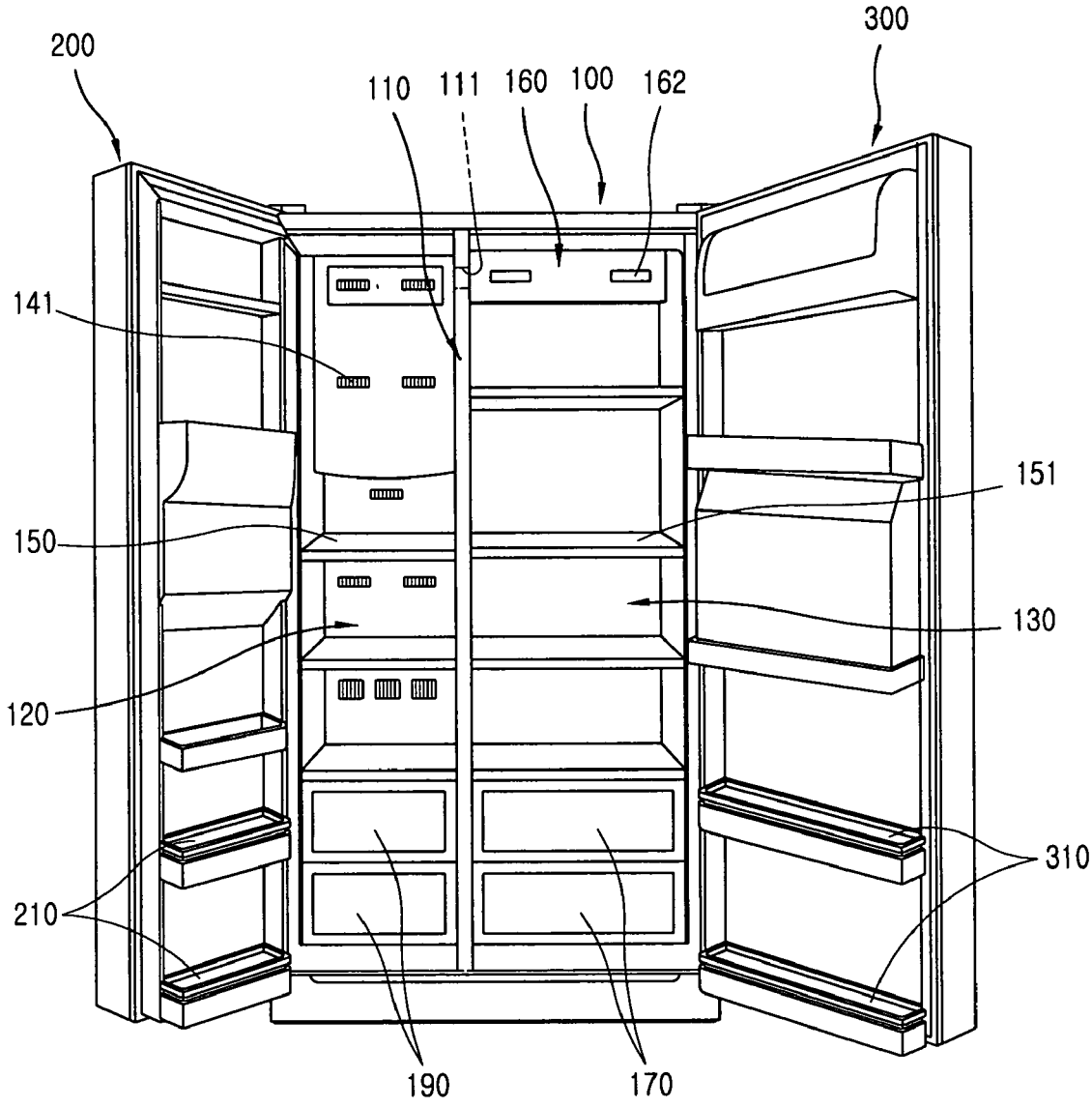
FIG. 1 CONVENTIONAL ART
FIG. 1 is a perspective view illustrating an example of a general refrigerator.
Figure 2:
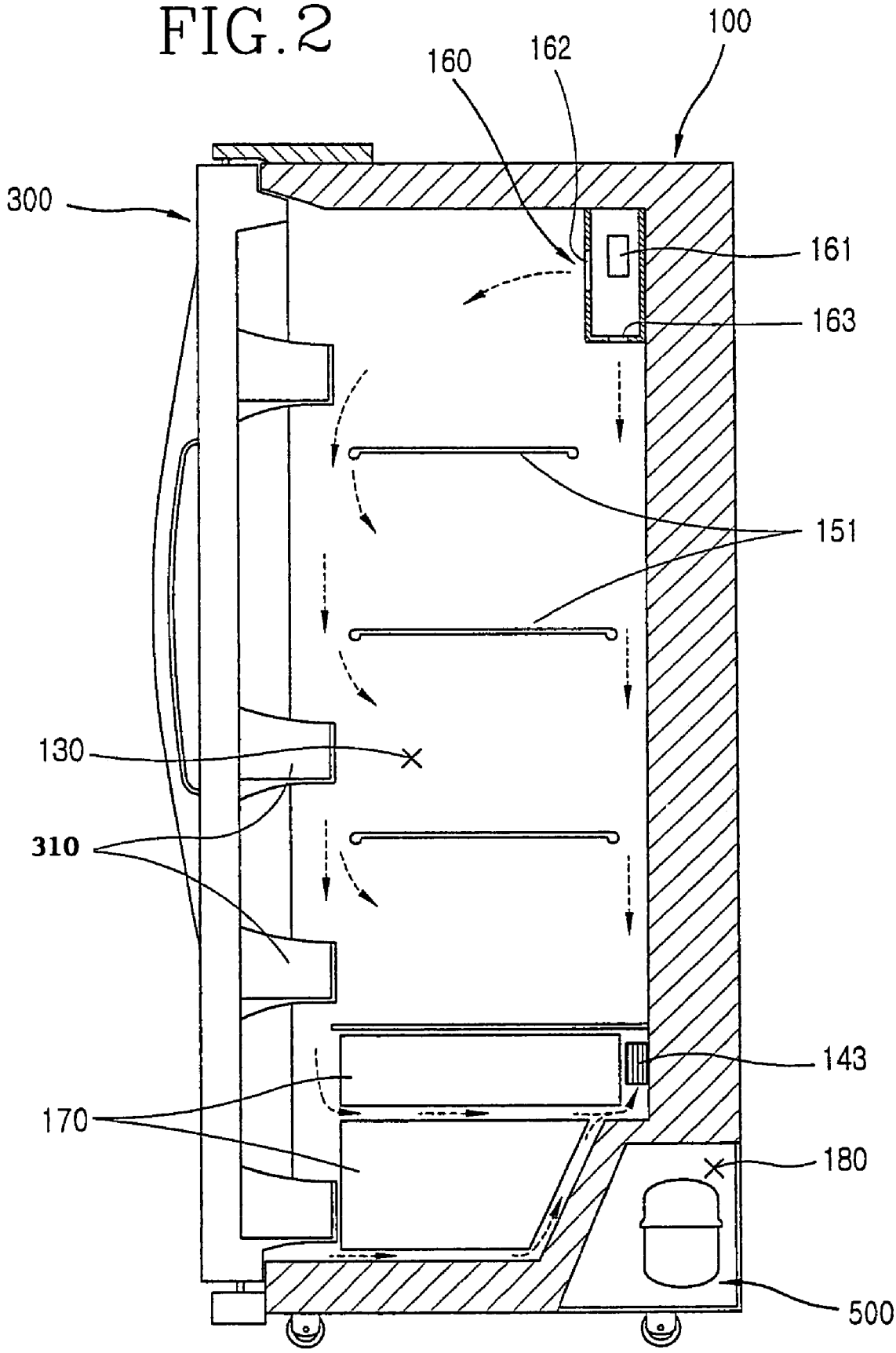
FIG. 2 is a side-sectional view illustrating a chilling chamber of the refrigerator.
Figure 3:
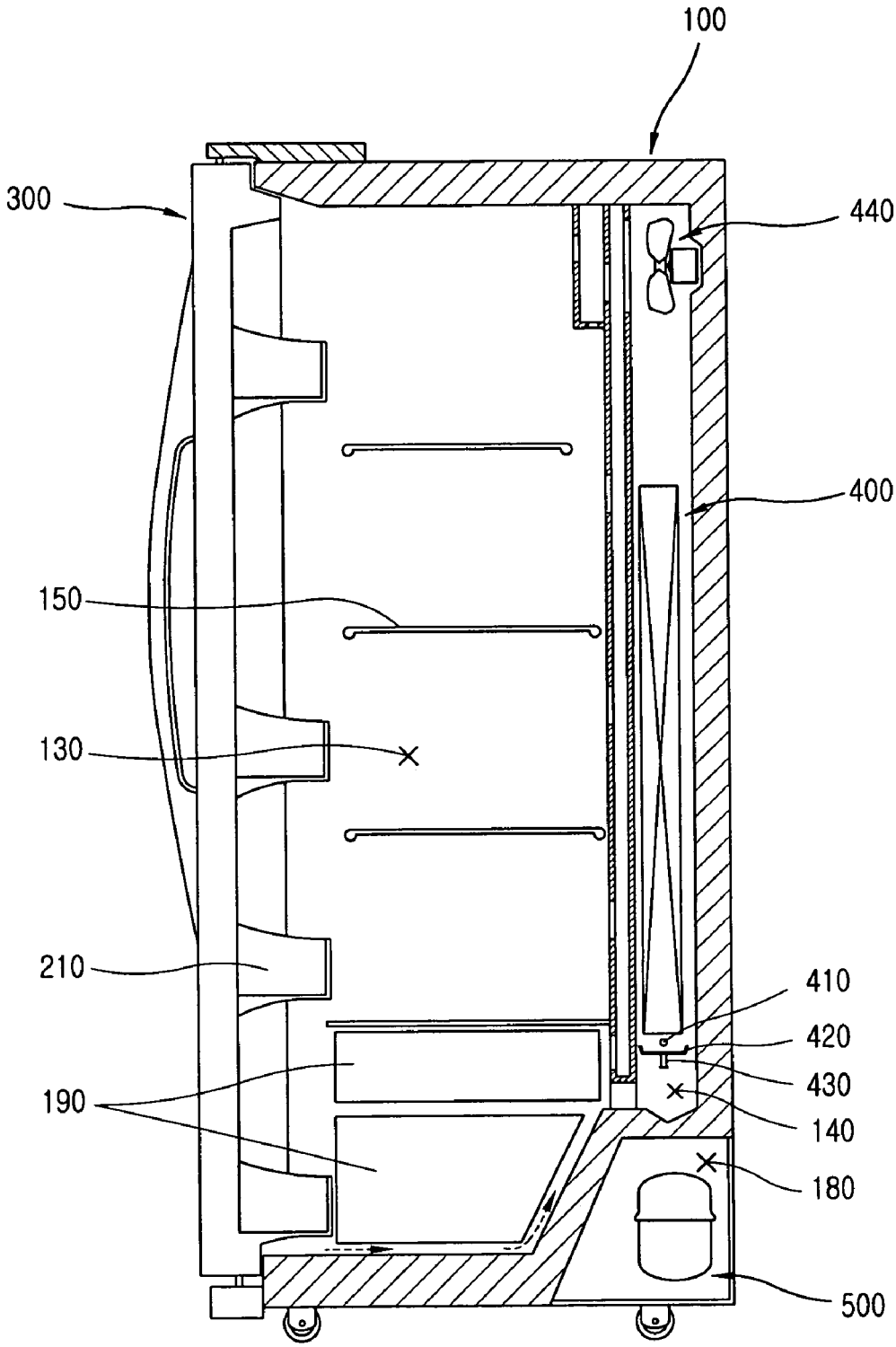
FIG. 3 CONVENTIONAL ART
FIG. 3 is a side-sectional view illustrating a freezing chamber of the refrigerator.
Figure 4:
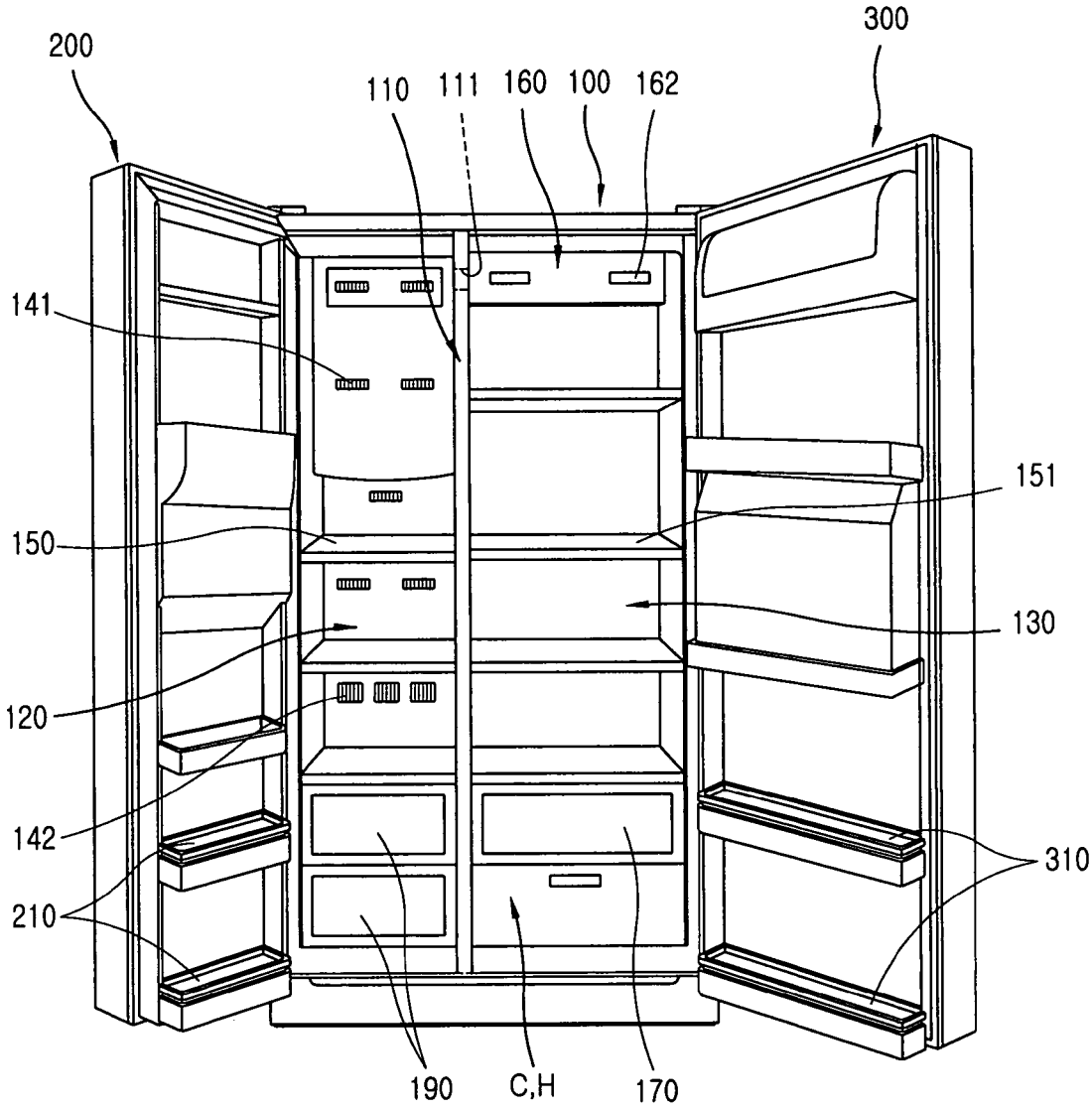
FIG. 4 is a perspective view illustrating a refrigerator in accordance with an embodiment of the present invention.
Figure 5:
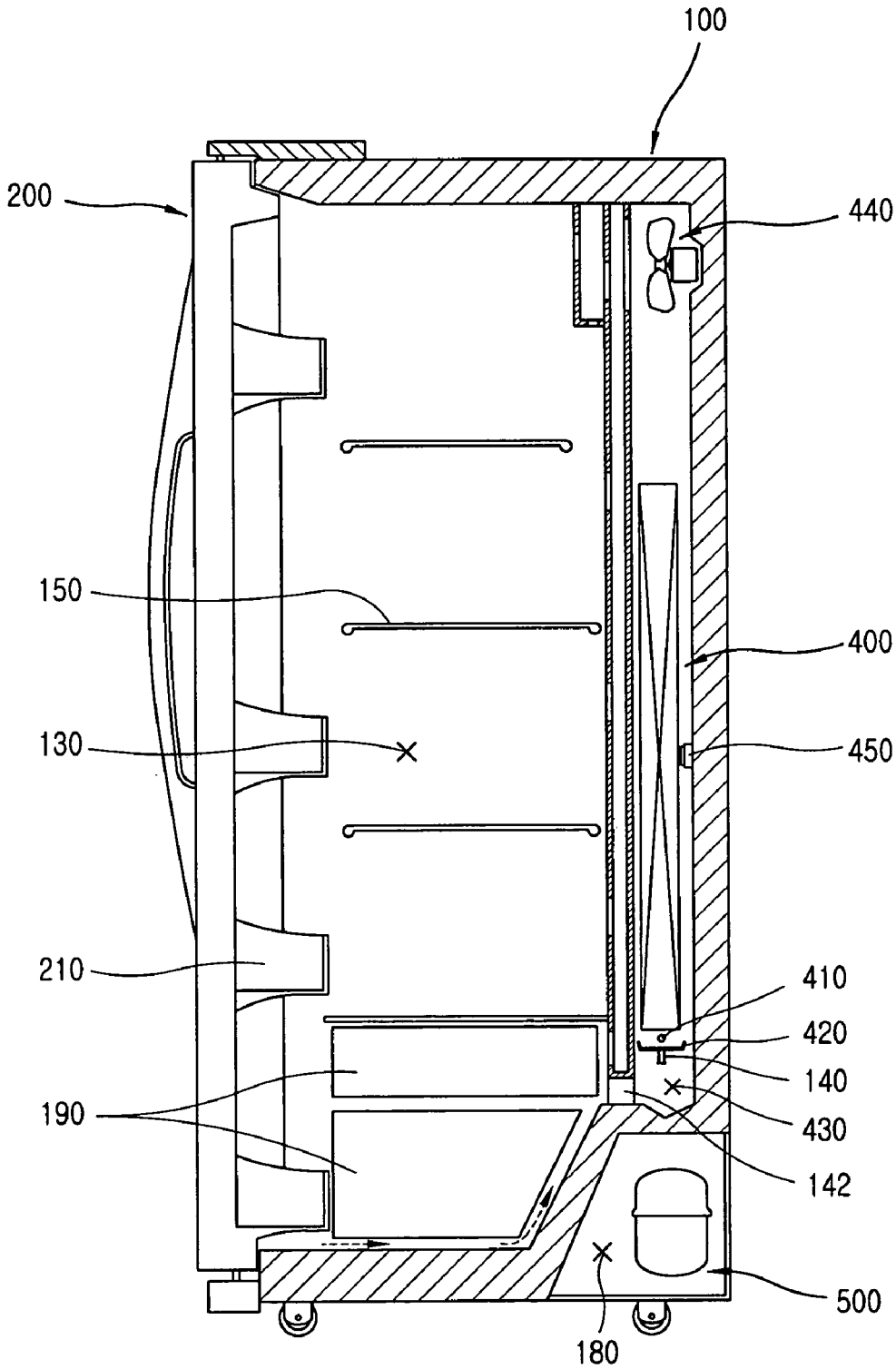
FIG. 5 is a side-sectional view illustrating a freezing chamber of the refrigerator in accordance with the present invention.
Figure 6:
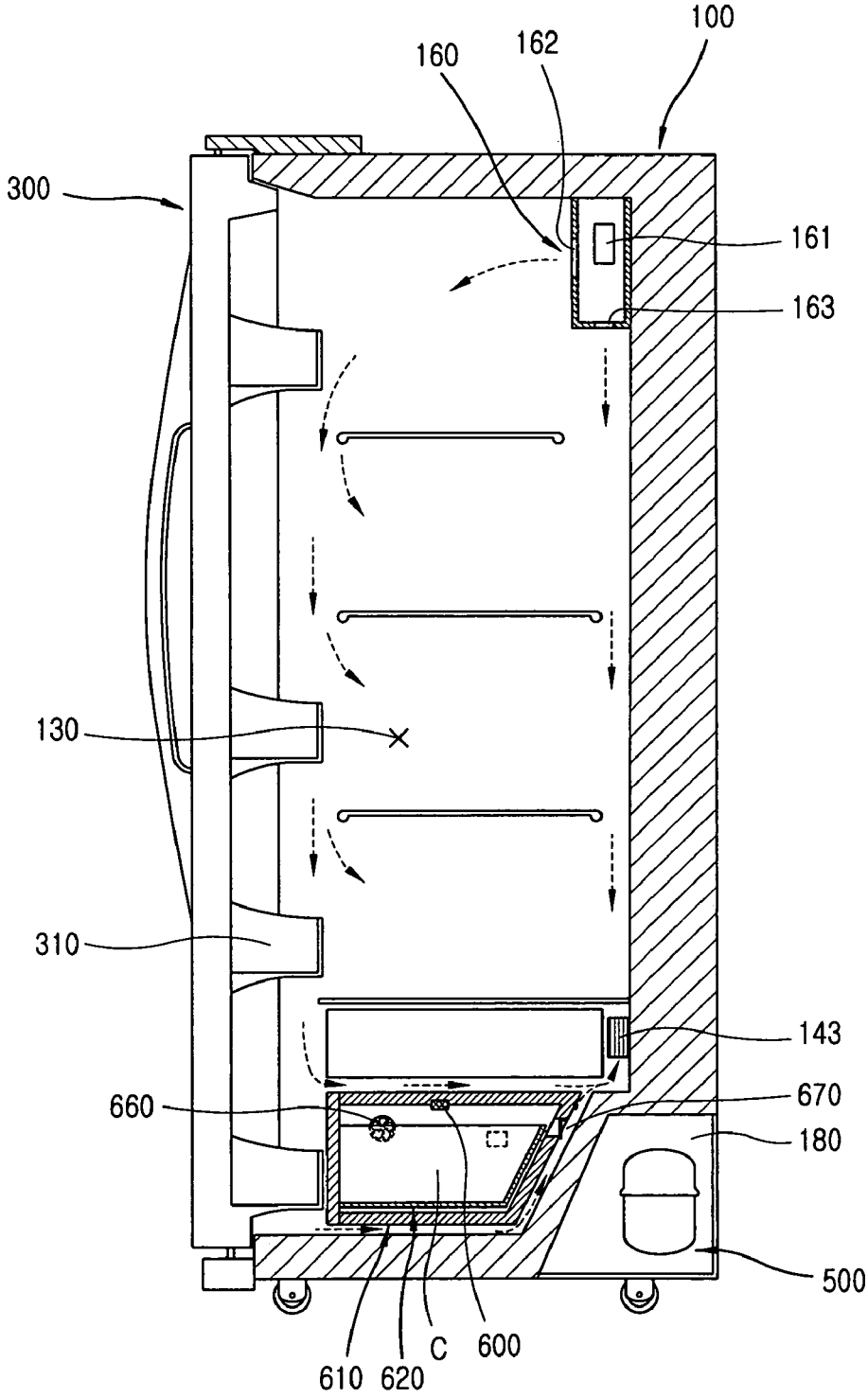
FIG. 6 is a side-sectional view illustrating a chilling chamber of the refrigerator in accordance with the present invention.
Figure 7:
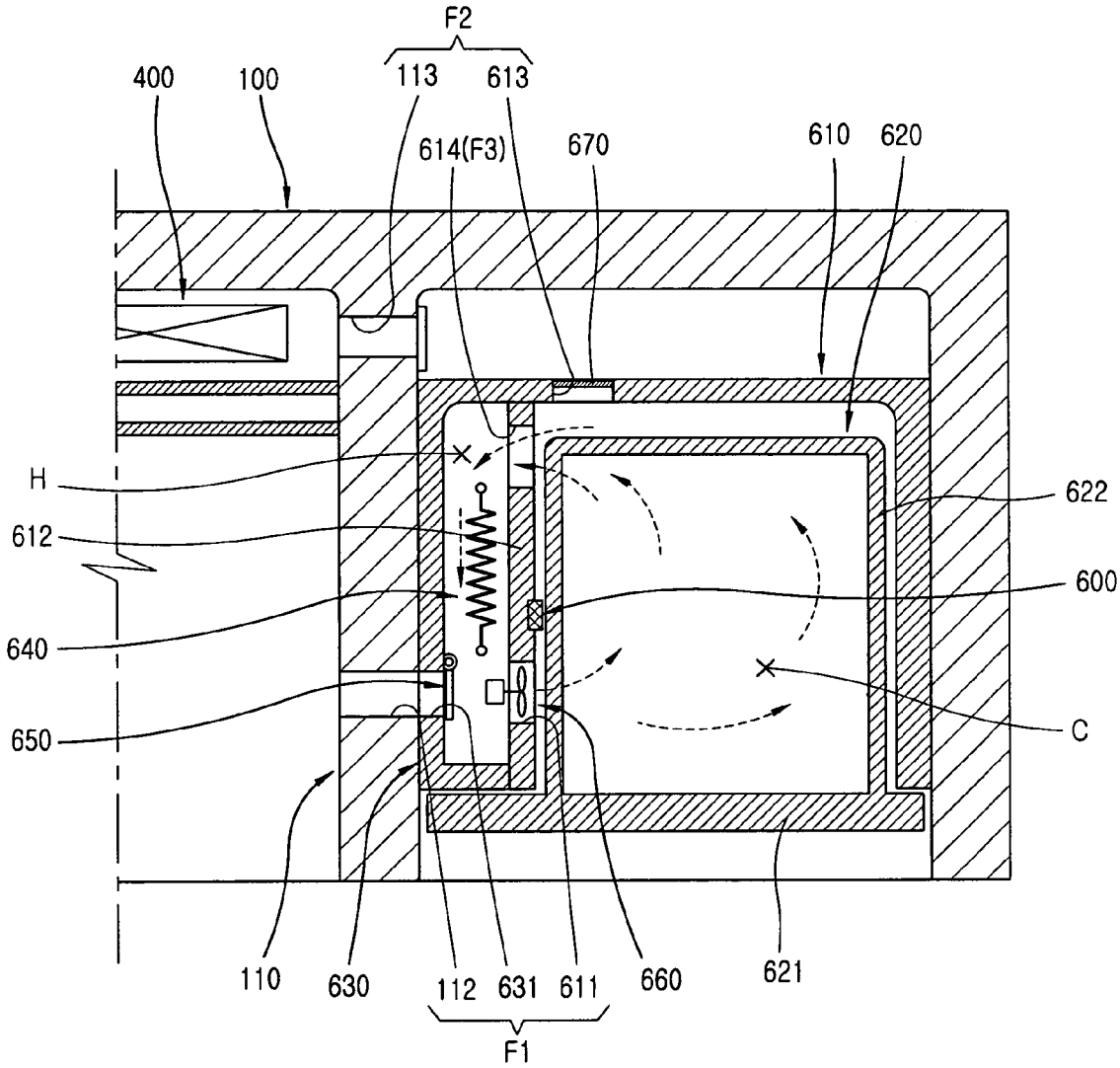
FIG. 7 is a partial-sectional view illustrating the refrigerator in accordance with the present invention.

FIG. 4 is a perspective view illustrating a refrigerator in accordance with an embodiment of the present invention, FIG. 5 is a side-sectional view illustrating a freezing chamber of the refrigerator in accordance with the present invention, FIG. 6 is a side-sectional view illustrating a chilling chamber of the refrigerator in accordance with the present invention, and FIG. 7 is a partial-sectional view illustrating the refrigerator in accordance with the present invention. The same parts with those of the conventional refrigerator will have the same reference numerals.

As depicted in FIGS. 4~7, in the refrigerator, a partition wall 110 is formed in a main body 100 in the up and down direction, a freezing chamber 120 and a chilling chamber 130 are respectively formed on the left and the right of the partition wall 110. A freezing chamber door 200 for opening/closing the freezing chamber 120 is combined with a side of the main body 100, and a chilling chamber door 300 for opening/closing a chilling chamber 130 is combined with the other side of the main body 100. A machine room 180 is formed on the rear lower portion of the main body 100, and a compressor, etc. is installed in the machine room 180.

A rear path 140 in which cool air circulates is formed in the rear wall of the freezing chamber 120, and an evaporator 400 is installed in the rear path 140. Plural cool air discharge holes 141 for discharging cool air into the freezing chamber 120 are formed in the rear wall of the freezing chamber 120, and the cool air discharge holes 141 are connected with the rear path 140. An outflow through hole 142 for passing cool air through the freezing chamber 120 into the rear path 140 is formed at a lower region of the freezing chamber 120.

A duct 160 on which the cool air discharge holes 162, 163 are formed is installed on the internal top portion of the chilling chamber 130, and an inflow through hole 111 for passing cool air generated in the evaporator 400 into the duct 160 is formed on the top region of the partition wall 110. A first damper 161 for adjusting a quantity of cool air flowing into the inflow through hole 111 is installed in the duct 160. An outflow through hole 143 connected to the rear path 140 is formed on the lower region of the partition wall 110 in order to make the cool air circulating the chilling chamber 130 flow to the evaporator 400.

Shelves 150, 151 on which food is mounted are respectively inserted into the freezing chamber 120 and the chilling chamber 130 at regular intervals.

A variable temperature storage (C) having a certain space is formed in the chilling chamber 130, a heating room (H) is formed on a side of the variable temperature storage (C), and a heating means for generating heat in power supply is installed to the heating room (H).

In the main body 100, a first path F1 in which cool air of the freezing chamber 120 flows into the variable temperature storage (C) and a second path F2 in which cool air in the variable temperature storage (C) flows into the rear path 140 are respectively formed. And, an adjusting means is respectively formed at the first and second paths F1, F2 in order to adjust a quantity of inflow and outflow cool air in the variable temperature chamber (C). The first local circulating path includes a first path F1 in which cool air in the freezing chamber 120 flows into the variable temperature storage (C); and a second path F2 in which cool air in the variable temperature storage (C) flows into the rear path 140.

Between the variable temperature storage (C) and the heating room (H), a third path F3 in which cool air in the variable temperature storage (C) flows into the heating room (H) and a fourth path F4 in which air heated in the heating room (H) flows into the variable temperature storage (C) are respectively formed, and a temperature sensor 600 for detecting a temperature is installed in the variable temperature storage (C). The second local circulating path includes the third path F3 in which air in the variable temperature storage (C) flows into the heating room (H); and the fourth path F4 in which air heated in the heating room (H) flows into the variable temperature storage (C).

The variable temperature storage (C) is formed by a casing 610 installed in the chilling chamber 130 and a drawer 620 detachably inserted into the casing 610, and the heating room (H) is formed by a sealed casing (box) 630 that shares a side wall of the casing 610.

The casing 610 has a certain inner space, a rectangular shape and the open front. The casing 610 is installed in the chilling chamber 130 so as to have a certain distance from the rear wall of the chilling chamber 130. The drawer 620 includes the rectangular front portion 621 covering the front of the casing 610 and a rectangular storing portion 622 extended-formed on a side of the front portion 621 so as to store food, and height of the storing portion 622 is less than height of the front portion 621. When the drawer 620 is inserted into the casing 610, the front portion 621 of the drawer 620 covers the front of the casing 610.

The casing 610 and the sealed casing 630 are made of heat-insulating materials.

The heating means is a wire heater 640, and the wire heater 640 is installed in the heating room (H). Besides the wire heater 640, the heating means can be constructed variously.

The sealed casing 630 is arranged on the partition wall 110 for partitioning a space in the refrigerator into the freezing chamber 120 and the chilling chamber 130.

The first path F1 includes a first through hole 112 on the partition wall 110, a second through hole 631 on a side wall of the sealed casing 630; and a third through hole 611 on the other side wall of the sealed casing 630. The wall 612 on which the third through hole 611 is formed partitions a space in the refrigerator into the casing 610 and the sealed casing 630, namely, the heating room (H) and the variable temperature storage (C).

The second path F2 includes a fourth through hole 613 on the rear wall of the casing 610 and a fifth through hole 113 formed on the rear of the partition wall 110. The fifth through hole 113 is connected with the rear path 140, the fourth through hole 613 and the fifth through hole 113 are connected with a certain space between the casing 610 and the rear wall of the chilling chamber 130.

The third path F3 is a sixth through hole 614 formed on the rear of the wall 612 on which the third through hole 611 is formed, and the fourth path F4 is the third through hole 611 formed on the wall 612 between the heating room (H) and the variable temperature storage (C).

The adjusting means includes a second damper installed on the second through hole 631 of the first path F1 in order to adjust a quantity of cool air flowing through the second through hole 631; a sub fan 660 installed on the third through hole 611 in order to flow air; and a check valve 670 for opening/closing the fourth through hole 613 of the second path F2.

In the meantime, when the second through hole 631 is closed, the sub fan 660 circulates air in the heating room (H) and the variable temperature storage (C).

A main fan 440 is installed at a side of the evaporator 400 in order to circulate cool air heat-exchanged in the evaporator 400, and a defrost heater 410 is installed on the evaporator 400 in order to remove frost periodically. A defrost water tray 420 is installed below the evaporator 400 in order to receive defrost water, and a defrost water distributing pipe 430 is connected to the bottom of the defrost water tray 420 in order to guide defrost water to the machine room 180.

And, an ultrasonic generator 450 is installed at the inner wall above the evaporator 400 in order to generate ultrasonic waves to the evaporator 400.

A microcomputer (not shown) is installed at a side of the main body 100 of the refrigerator in order to control the operation of the refrigerator.

The operation of the refrigerator will be described as following.

First, by the operation of the compressor 500, outside heat is absorbed in the evaporator 400, and cool air is generated. Simultaneously, when the main fan 440 is rotated, cool air generated in the evaporator 400 flows through the rear path 140.

The cool air flowing through the rear path 140 is discharged into the freezing chamber 120, the cool air in the freezing chamber 120 passes the evaporator 400 and flows again into the freezing chamber 120, and accordingly the freezing chamber 120 is maintained in a cool state. Part of the cool air flowing through the rear path 140 is discharged into the chilling chamber 130, passes the evaporator 400 and flows again into the chilling chamber 130, and accordingly the chilling chamber 130 is maintained in a cool state. The operation is similar to that of the conventional art.

And, in order to store various foods inappropriate to the vegetable storage 170 such as tropical fruits or unfrozen fresh mean, etc. in the variable temperature storage (C), a temperature of the variable temperature storage (C) is adjusted as following.

First, in order to adjust a temperature of the variable temperature storage (C) so as to be a little lower than a temperature of the chilling chamber 130, when power is not supplied to the wire heater 640, by opening the second damper 650 installed to the second through hole 631 of the first path F1, the first path F1 for connecting the freezing chamber 120 with the variable temperature storage (C) is open. In addition, by opening the check valve 670, the fourth through hole 613 is open, and the sub fan 660 is rotated. When air flows are generated by rotating the sub fan 660, cool air in the freezing chamber 120 flows into the variable temperature storage (C) formed by the casing 610 and the drawer 620 through the first, second and third through holes 112, 631, 611. The cool air in the variable temperature storage (C) flows into the rear path 140 through the fourth and fifth through holes 613, 113.

By continuing the process, a temperature in the variable temperature storage (C) is lowered according to cool air of the freezing chamber 120. Temperature in the variable temperature storage (C) is sensed by the temperature sensor 600, when the sensed temperature reaches a set temperature, the operation of the sub fan 660 is stopped, the second damper 650 closes the second through hole 631, the check valve 670 closes the fourth through hole 613, flow of the cool air is cut off, and the set temperature is maintained.

In order to rise a temperature in the variable temperature storage (C) so as to be higher than a temperature in the chilling chamber 130, the first path F1 is cut off by closing the second through hole 631 of the first path F1 with the second damper 650, the check valve 670 closes the fourth through hole 613, power is supplied to the wire heater 640, the wire heater 640 generates heat, and simultaneously the sub fan 660 is operated. By the operation of the sub fan 660, air in the variable temperature storage (C) flows into the heating chamber (H) formed by the sealed casing 630 through the sixth through hole 614, the air is heated by the wire heater 640, and the heated air flows into the variable temperature storage (C) through the third through hole 611. By continuing the circulating process, a temperature in the variable temperature storage (C) rises.

When a temperature in the variable temperature storage (C) sensed by the temperature sensor 600 is not less than a set temperature, power supply to the wire heater 640 is stopped, and the rotation of the sub fan 660 is stopped.

By the operation, a temperature in the variable temperature storage (C) can be variously adjusted.

While the cool air circulates the freezing chamber 120 and the chilling chamber 130, moisture gathers onto the evaporator 400, defrost is generated on the evaporator 400, and a defrosting operation is performed in order to remove frost. In the defrosting operation, by heat generated by the defrost heater 410, frost melts, simultaneously when the ultrasonic generator 450 generates ultrasonic waves, frost on the evaporator 400 is vibrated-heated, frost is easily separated from the evaporator 400 and drops into the defrost water tray 420. By removing frost by using the defrost heater 410 and the ultrasonic generator 450, frost can be removed in a short time, and accordingly a defrosting operation time can be reduced.

Figure 8:
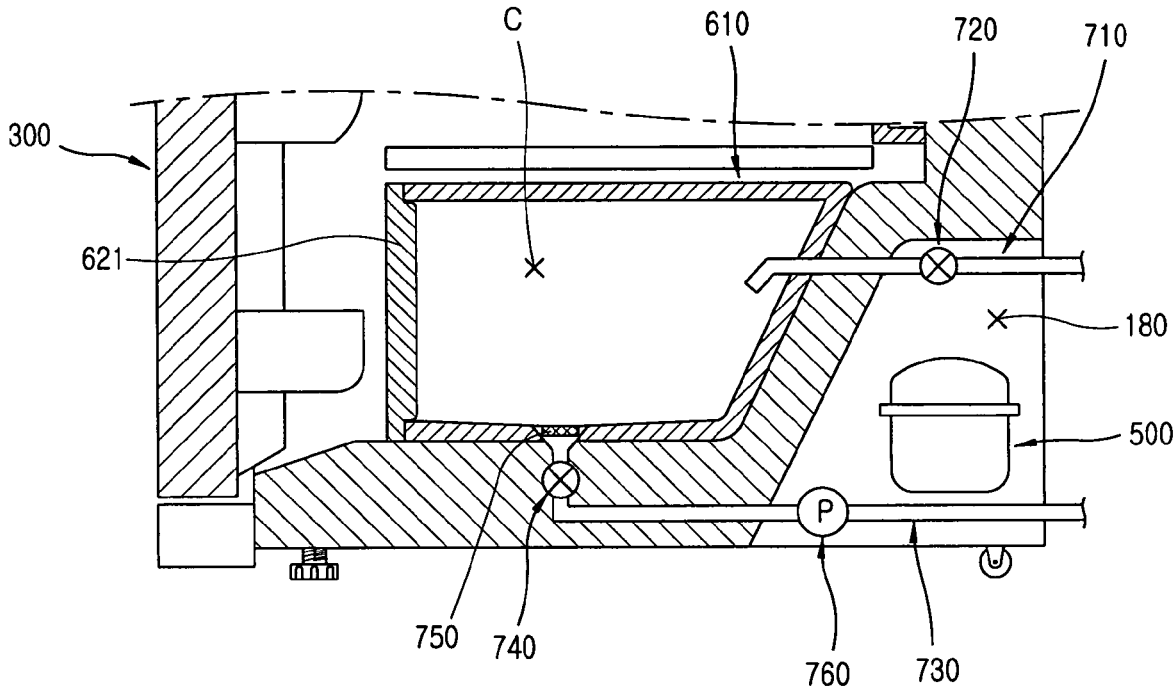
FIG. 8 is a side-sectional view illustrating a refrigerator in accordance with another embodiment of the present invention.
Figure 9:
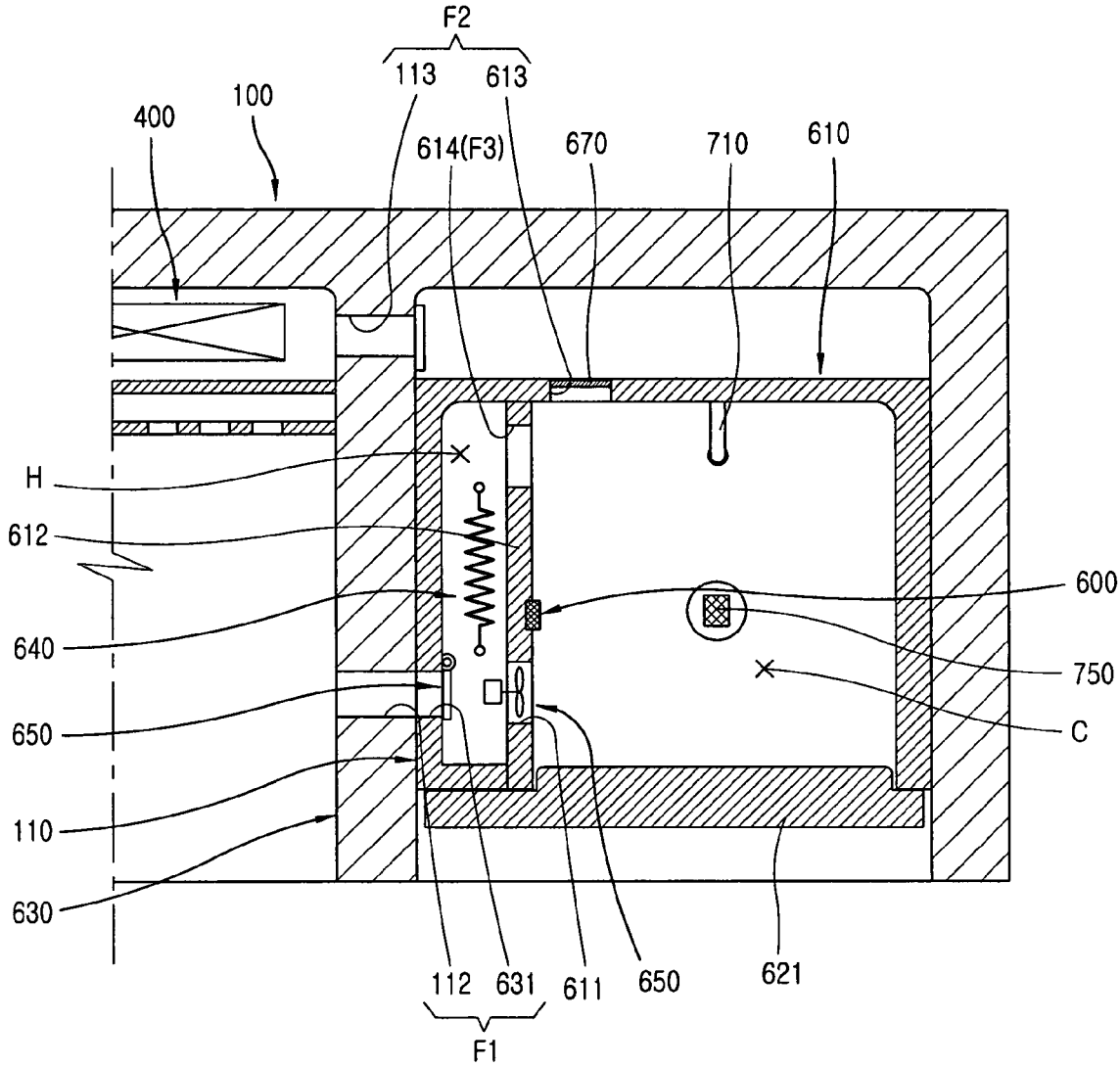
FIG. 9 is a plane-sectional view illustrating the refrigerator in accordance with another embodiment of the present invention.

In the meantime, FIG. 8 is a side-sectional view illustrating a refrigerator in accordance with another embodiment of the present invention, and FIG. 9 is a plane-sectional view illustrating the refrigerator in accordance with another embodiment of the present invention. The same parts with those of the first embodiment of the present invention will have the same reference numerals.

As depicted in FIGS. 8 and 9, in the refrigerator, a washing means for washing vegetables or fruits is arranged in the variable temperature storage (C).

The washing means includes a water supply pipe 710 for supplying washing water to the variable temperature storage (C); a water supply valve 720 installed to the water supply pipe 710 in order to adjust supply of washing water; a drainage pipe 730 connected to the variable temperature storage (C) in order to drain washing water; a drainage valve 740 installed to the drainage pipe 730 in order to adjust drainage; and a vibration generator 750 for vibrating washing water contained in the variable temperature storage (C).

The variable temperature storage (C) can be fabricated by an additional casing having a structure different from that of the casing 610.

The water supply pipe 710 is arranged on the machine room 180, and an outlet of the water supply pipe 710 is arranged on the inner upper portion of the variable temperature storage (C).

The drainage pipe 730 is arranged on the machine room 180, and an inlet of the drainage pipe 730 is arranged on the bottom of the variable temperature storage (C), and the vibration generator 750 is installed on an inlet side of the drainage pipe 730.

And, the drainage pump 760 is installed on the drainage pipe 730.

When the drainage valve 740 is closed, vegetables or fruits are put into the variable temperature storage (C), and the water supply valve 720 is open, washing water flows into the variable temperature storage (C) through the water supply pipe 710. When the variable temperature storage (C) is filled with a certain amount of washing water, the water supply valve 720 is closed, the vibration generator 750 is operated, and accordingly the washing water vibrates. While the washing water vibrates, vegetables or fruits in the variable temperature storage (C) are washed. After finishing the washing process, the drainage valve 740 is open, simultaneously the drainage pump 760 is open, and the washing water is discharged.

An amount of washing water in the variable temperature storage (C) and washing degree of vegetables and fruits are detected by an additional sensor (not shown). The water supply pipe 710 can be connected to a water tap, and the drainage pipe 730 can be connected to an additional drainage pipe.

The vegetable or fruits passing the washing process are stored in the variable temperature storage (C) at an optimum storing temperature through the above-described processes. In the meantime, a user can perform the washing process right before eating or using the vegetable or fruits stored in the variable temperature storage (C).

Figure 10:
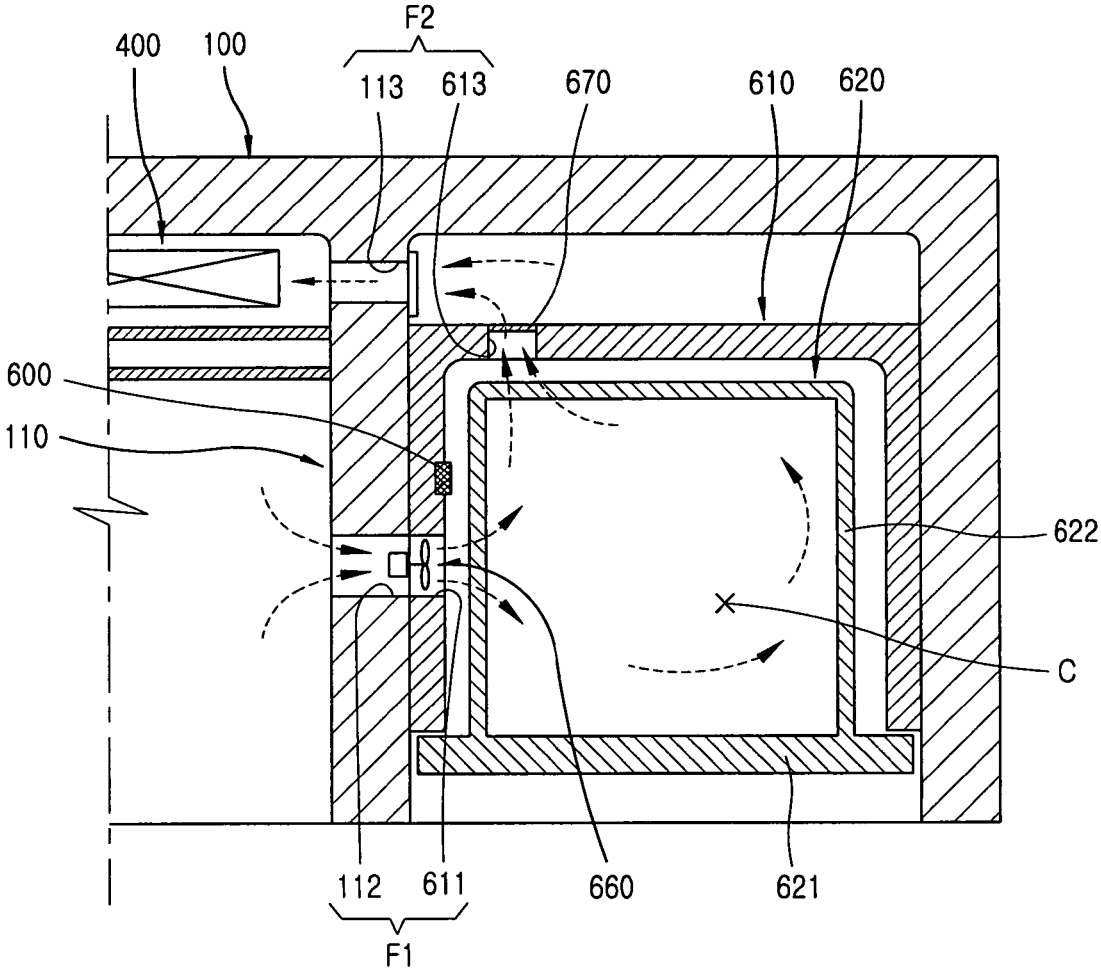
FIGS. 10, 11 and 12 are plane-sectional views respectively illustrating refrigerators in accordance with other embodiments of the present invention.

FIG. 10 is a plane-sectional view illustrating a refrigerator in accordance with yet another embodiment of the present invention.

As depicted in FIG. 10, the refrigerator includes a variable temperature storage (C) formed in the chilling chamber 130 so as to have a certain space; a first path F1 in which cool air in the freezing chamber 120 flows into the variable temperature storage (C); a second path F2 in which cool air in the variable temperature storage (C) flows into the rear path 140; an adjusting means for adjusting a quantity of cool air inflow/outflow in the variable temperature storage (C); and a temperature sensor 600 for sensing a temperature in the variable temperature storage (C).

The variable temperature storage (C) is formed by a casing 610 inserted into the chilling chamber 130 and a drawer 620 detachably inserted into the casing 610.

The casing 610 has a certain inner space, a rectangular shape and the open front. The casing 610 is installed in the chilling chamber 130 so as to have a certain distance from the rear wall of the chilling chamber 130. The drawer 620 includes the rectangular front portion 621 covering the front of the casing 610 and a rectangular storing portion 622 extended-formed on a side of the front portion 621 so as to store food, and height of the storing portion 622 is less than height of the front portion 621. When the drawer 620 is inserted into the casing 610, the front portion 621 of the drawer 620 covers the front of the casing 610.

The casing 610 and the sealed casing 630 are made of heat-insulating materials.

A first path F1 includes a first through hole 112 formed on the partition wall 110 for partitioning the space into the freezing chamber 120 and the chilling chamber 130 and a third through hole 611 formed on a side wall of the casing 610, and the first and third through holes 112, 611 are arranged on the same line.

The second path F2 includes a fourth through hole 613 formed on the rear wall of the casing 610 and a fifth through hole 113 formed on the rear region of the partition wall 110 for partitioning the space into the freezing chamber 120 and the chilling chamber 130.

The fifth through hole 113 is connected with the rear path 140, and the fourth and fifth through holes 613, 113 are connected with a certain space between the casing 610 and the rear wall of the chilling chamber 130.

The adjusting means includes the sub fan 660 installed on the first path F1 in order make air flow and a check valve 670 for opening/closing the second path F2.

Figure 11:
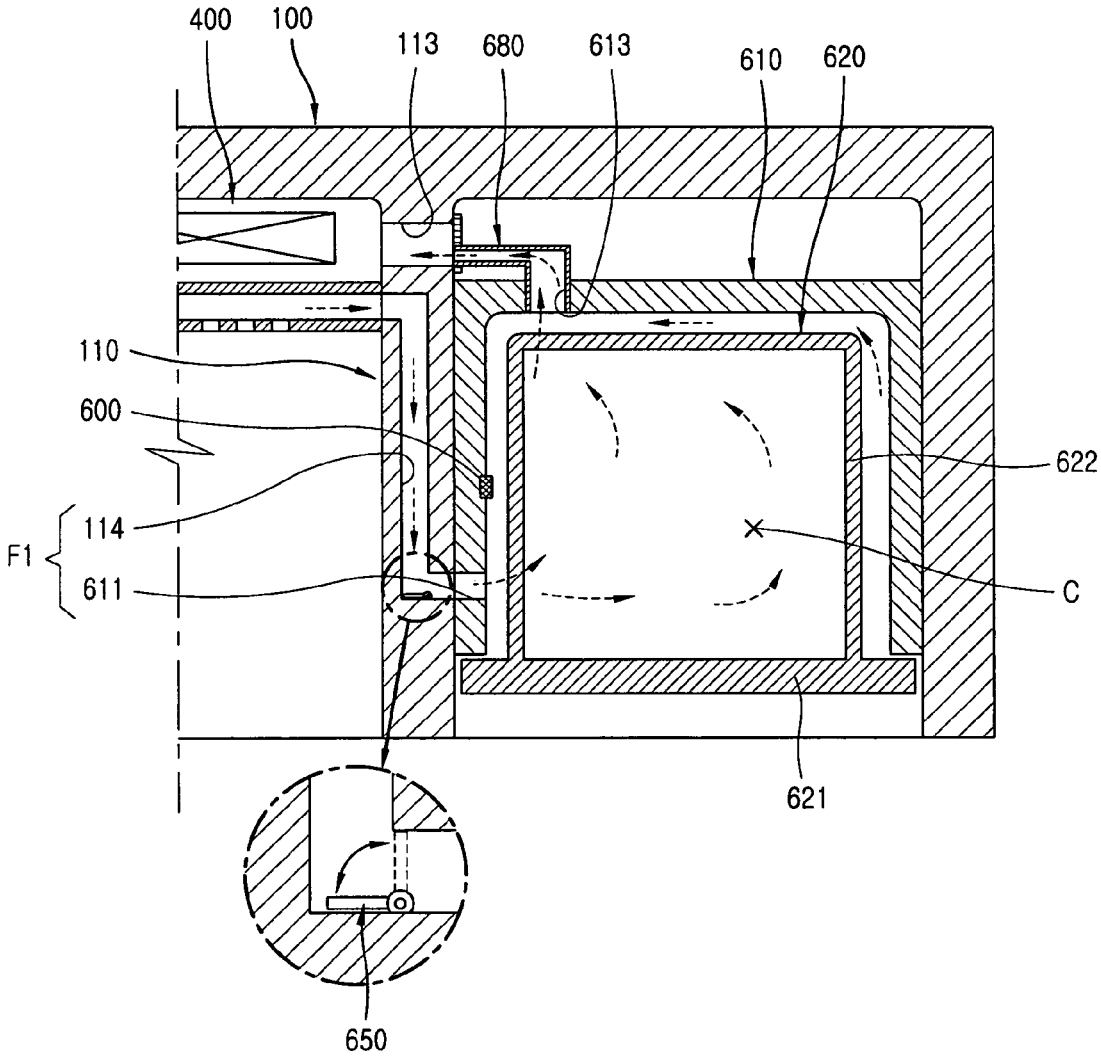

As depicted in FIG. 11, as another example of the adjusting means, in order to make cool air passing the evaporator 400 flow into the variable temperature storage (C), a first path F1 includes a seventh through hole 114 formed on the partition wall 110 and a third through hole 611 formed on a side wall of the casing 610. The third and seventh through holes are connected with each other. And, a second damper 650 is installed in the seventh through hole 114 in order to adjust a quantity of cool air.

And, the fourth and fifth through holes 613, 113 are connected with each other by a connection pipe 680.

The operation of the refrigerator will be described.

First, in order to adjust a temperature in the variable temperature storage (C) so as to be lower than that of the chilling chamber 130, when the sub fan 660 is rotated, by the rotational force of the sub fan 660, cool air in the freezing chamber 120 flows into the variable temperature storage (C) formed by the casing 610 and the drawer 620 through the first and third through holes 112, 611. When the cool air flows into the variable temperature storage (C), by the pressure of the cool air, the check valve 670 is open, and the cool air flows into the rear path 140 through the fourth and fifth through holes 613, 113. By continuing the process, when a temperature in the variable temperature storage (C) lowers and the temperature sensor 600 detects a temperature in the variable temperature storage (C) reaches a set temperature, the operation of the sub fan 660 is stopped. Herein, the pressure of the cool air is removed, the check valve 670 closes the fifth through hole 113, and accordingly that temperature is maintained.

In another example of the adjusting means, when the second damper 650 on the first path F1 opens the seventh through hole 114 of the first path F1, by the rotational force of the main fan 440 arranged on a side of the evaporator 400, part of cool air passing the evaporator 400 flows into the variable temperature storage (C) through the seventh and third through holes 114, 611, the cool air in the variable temperature storage (C) circulates-flows the variable temperature storage (C) and flows into the rear path 140 through the connection pipe. By continuing the process, a temperature in the variable temperature storage (C) lowers and the temperature sensor 600 detects a temperature in the variable temperature storage (C) reaches a set temperature, the second damper 650 closes the seventh through hole 114 in order to cut off cool air inflow to the variable temperature storage (C), and accordingly the temperature is maintained.

In that structure, it is possible to maintain a temperature within a range higher than that of the freezing chamber 120 and lower than that of the chilling chamber 130, and food required to be stored in that range can be stored efficiently. For example, in order to have meat having less drip and original flavor, meat has to be preserved within the temperature range of −7° C.~−3° C., and that temperature range can be maintained.

Figure 12:
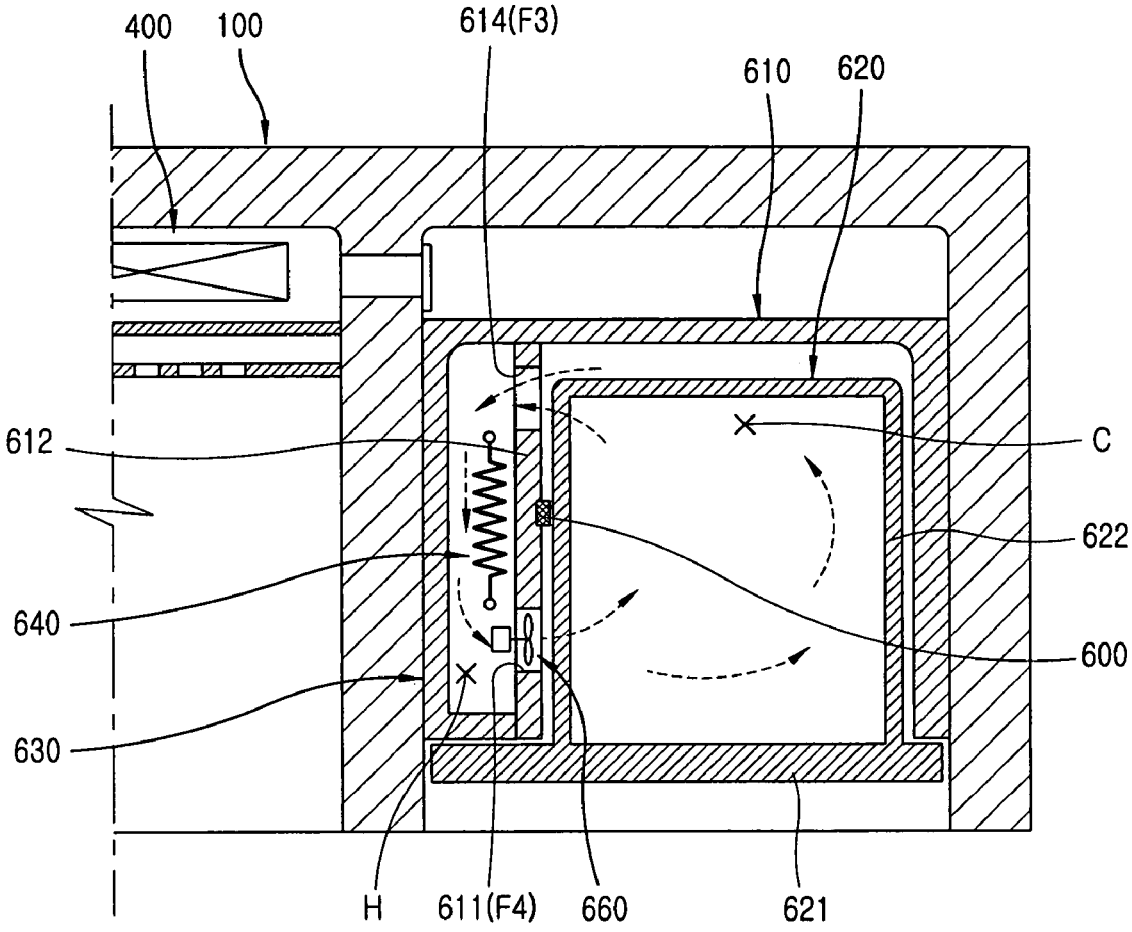

FIG. 12 is a plane-sectional view illustrating a refrigerator in accordance with still yet another embodiment of the present invention. The same parts with those of the conventional refrigerator will have the same reference numerals.

As depicted in FIG. 12, the refrigerator includes a variable temperature storage (C) formed in the chilling chamber 130 so as to have a certain space; a heating room (H) formed on a side of the variable temperature storage (C); a heating means installed in the heating room (H) to generate heat in power supply; a third path F3 in which air in the variable temperature storage (C) flows into the heating room (H); a fourth path F4 in which air heated in the heating room (H) into the variable temperature storage (C); a sub fan 660 installed in the heating room (H) to generate air flows; and a temperature sensor 600 for detecting a temperature in the variable temperature storage (C).

The variable temperature storage (C) is formed by a casing 610 installed in the chilling chamber 130 and a drawer 620 detachably inserted into the casing 610, and the heating room (H) is formed by a sealed casing 630 having a side wall of the casing 610.

The casing 610 has a certain inner space, a rectangular shape and the open front. The casing 610 is installed in the chilling chamber 130 so as to have a certain distance from the rear wall of the chilling chamber 130. The drawer 620 includes the rectangular front portion 621 covering the front of the casing 610 and a rectangular storing portion 622 extended-formed on a side of the front portion 621 so as to store food, and height of the storing portion 622 is less than height of the front portion 621. When the drawer 620 is inserted into the casing 610, the front portion 621 of the drawer 620 covers the front of the casing 610.

The casing 610 and the sealed casing 630 are made of heat-insulating materials.

The heating means is a wire heater 640, and the wire heater 640 is installed in the heating room (H).

The third path F3 consists of a sixth through hole 614 formed on the inner region of the partition wall 612 for partitioning the space into the heating room (H) and the variable temperature storage (C), and the fourth path F4 consists of a third through hole 611 formed on the front region of the partition wall 612.

The sub fan 660 is installed in the heating room (H) so as to be arranged on the third through hole 611.

The operation of the refrigerator will be described.

First, when a comparatively higher storing temperature is required in order to store tropical fruits, etc. in the variable temperature storage (C), power is supplied to the wire heater 640, and the sub fan 660 is operated. According to the power supply to the wire heater 640, heat is generated in the wire heater 640, by the rotation of the sub fan 660, air heated by the wire heater 640 flows into the variable temperature storage (C) through the third through hole 611. The warm air flows into the heating room (H) through the sixth through hole 614 while circulating the variable temperature storage (C), the air having a comparatively lower temperature is heated by the wire heater 640, and it inflows into the variable temperature storage (C) again.

By continuing the process, a temperature in the variable temperature storage (C) rises, when the temperature sensor 600 senses a temperature in the variable temperature storage (C) reaches a set temperature, power supplied to the wire heater 640 is stopped, the operation of the sub fan 660 is stopped, and accordingly the set temperature is maintained.

As described above, in the refrigerator in accordance with the present invention, by including the variable temperature storage (C) capable of maintaining various temperature ranges in the chilling chamber 130 or the freezing chamber 120, it is possible to perform optimum temperature storing of foods, various foods can be stored freshly for a longer time, and accordingly a user can use the refrigerator more conveniently.

In addition, by reducing a defrosting operation time for removing frost formed on the evaporator 400, it is possible reduce heat loss and control temperature control of the variable temperature storage (C) more accurately.

In addition, it is possible to wash vegetables or fruits in the refrigerator, the user can eat the vegetables or fruits without washing them additionally, and accordingly convenience of life can be improved.

What is claimed is:

1. A refrigerator, comprising:

a refrigerator main body having a freezing chamber and a chilling chamber in which foods are stored;

a machine room in which a compressor is installed;

a rear path in which cool air generated in an evaporator flows into the freezing chamber and the chilling chamber and flows back to the evaporator;

doors respectively combined with the refrigerator main body and configured to open and close the freezing chamber and the chilling chamber;

a variable temperature storage formed in the chilling chamber;

a heating room formed on a side of the variable temperature storage;

a heating device installed in the heating room and configured to generate heat;

a first local circulating path through which cool air in the freezing chamber flows into the rear path through the variable temperature storage;

an adjusting device configured to adjust a quantity of cool air flowing into/out of the variable temperature storage through the first local circulating path;

a second local circulating path in which air heated in the heating room passes through the variable temperature storage and flows into the heating room again; and a temperature sensor configured to sense a temperature in the variable temperature storage, wherein the variable temperature storage comprises a casing installed in the refrigerator and having a rear wall and two side walls, and wherein the first local circulating path comprises a through hole formed in one of the two side walls of the casing.

2. The refrigerator of claim 1, wherein the first local circulating path comprises:

a first path in which cool air in the freezing chamber flows into the variable temperature storage; and a second path in which cool air in the variable temperature storage flows into the rear path.

3. The refrigerator of claim 2, wherein the first local circulating path is formed on a partition wall that partitions a space in the refrigerator into the freezing chamber and the chilling chamber.

4. The refrigerator of claim 2, wherein the second local circulating path is formed on a partition wall that partitions a space in the refrigerator into the freezing chamber and the chilling chamber.

5. The refrigerator of claim 1, wherein the second local circulating path comprises:

a third path in which air in the variable temperature storage flows into the heating room; and a fourth path in which air heated in the heating room flows into the variable temperature storage.

6. The refrigerator of claim 5, further comprising a sub fan configured to circulate air installed on the fourth path.

7. The refrigerator of claim 1, wherein the variable temperature storage further comprises a drawer detachably inserted into the casing, and wherein the heating room is formed by a sealed casing sharing a side wall of the casing, and paths are formed both in the casing and the sealed casing.

8. The refrigerator of claim 7, wherein the casing and the sealed casing are formed of heat-insulating materials.

9. The refrigerator of claim 7, wherein the drawer comprises a front portion configured to cover a front of the casing and a storing portion extended from the front portion and configured to store food therein, and wherein a height of the storing portion is less than a height of the front portion.

10. The refrigerator of claim 1, wherein the adjusting device comprises:

a second damper installed on the first local circulating path and configured to adjust a quantity of cool air flowing through the first local circulating path;

a sub fan installed on the first local circulating path and configured to create air flow; and a check valve installed on the second local circulating path and configured to open and close the second local circulating path.

11. The refrigerator of claim 1, wherein the heating device is a wire heater.

12. The refrigerator of claim 1, further comprising an ultrasonic generator configured to generate ultrasonic waves for a defrosting operation installed on an upper inner wall of the evaporator.

13. The refrigerator of claim 1, further comprising a washing device configured to wash vegetables or fruits installed in the variable temperature storage.

14. The refrigerator of claim 13, wherein the washing device comprises:

a water supply pipe configured to supply washing water to the variable temperature storage;

a water supply valve installed on the water supply pipe and configured to adjust a supply of washing water;

a drainage pipe connected to the variable temperature storage and configured to drain washing water;

a drainage valve installed on the drainage pipe and configured to adjust drainage; and a vibration generator configured to vibrate washing water contained in the variable temperature storage.

15. The refrigerator of claim 14, further comprising a drainage pump installed on the drainage pipe.

16. A refrigerator, comprising:

a refrigerator main body having a freezing chamber and a chilling chamber in which foods are stored;

a machine room in which a compressor is installed;

a rear path in which cool air generated in an evaporator flows into the freezing chamber and the chilling chamber and flows back to the evaporator;

doors respectively combined with the refrigerator main body and configured to open and close the freezing chamber and the chilling chamber;

a variable temperature storage formed in the chilling chamber;

a first path in which cool air in the freezing chamber flows into the variable temperature storage;

a second path in which cool air in the variable temperature storage flows into the rear path;

an adjusting device configured to adjust a quantity of cool air flowing into and out of the variable temperature storage; and a temperature sensor configured to sense a temperature in the variable temperature storage, wherein the variable temperature storage comprises a casing installed in the refrigerator and having a rear wall and two side walls, and wherein the first path comprises a through hole formed in one of the two side walls of the casing.

17. The refrigerator of claim 16, wherein the adjusting device comprises:

a sub fan installed on the first path and configured to create air flow; and a check valve configured to open and close the second path.

18. The refrigerator of claim 17, wherein the adjusting device further comprises a damper installed on the first path and configured to control a quantity of cool air flowing into the first path, wherein the first path is connected with the sub fan which forces cool air to flow past the evaporator.

19. A refrigerator, comprising:

a refrigerator main body having a freezing chamber and a chilling chamber in which foods are stored;

a machine room in which a compressor is installed;

a rear path in which cool air generated in an evaporator flows into the freezing chamber and the chilling chamber and flows back into the evaporator;

doors respectively combined with the refrigerator main body and configured to open and close the freezing chamber and the chilling chamber;

a variable temperature storage formed in the chilling chamber;

a heating room formed on a side of the variable temperature storage;

a heating device installed in the heating room and configured to generate heat;

a first path through which air in the variable temperature storage flows into the heating room;

a second path in which air heated in the heating room flows into the variable temperature storage;

a sub fan installed in the heating room and configured to generate air circulating flow; and a temperature sensor configured to sense a temperature in the variable temperature storage, wherein the variable temperature storage comprises a casing having a rear and two side walls installed in the refrigerator and a drawer detachably inserted into the casing.

20. The refrigerator of claim 19, wherein the heating device comprises a wire heater.

21. The refrigerator of claim 19, wherein the variable temperature storage is made of a heat-insulating material.

22. A refrigerator, comprising:

a refrigerator main body having a freezing chamber and a chilling chamber in which foods are stored;

a machine room in which a compressor is installed;

a rear path in which cool air generated in an evaporator flows into the freezing chamber and the chilling chamber and flows back to the evaporator;

doors respectively combined with the refrigerator main body and configured to open and close the freezing chamber and the chilling chamber;

a variable temperature storage formed in the chilling chamber;

a heating room formed on a side of the variable temperature storage;

a heating device installed in the heating room and configured to generate heat;

a first local circulating path through which cool air in the freezing chamber flows into the rear path through the variable temperature storage;

an adjusting device configured to adjust a quantity of cool air flowing into/out of the variable temperature storage through the first local circulating path;

a second local circulating path in which air heated in the heating room passes through the variable temperature storage and flows into the heating room again; and a temperature sensor configured to sense a temperature in the variable temperature storage, wherein the variable temperature storage is formed by a casing installed in the refrigerator and comprises a drawer detachably inserted into the casing, and wherein the heating room is formed by a sealed casing sharing a side wall of the casing, and paths are formed both in the casing and the sealed casing.

23. The refrigerator of claim 22, wherein the casing and the sealed casing are formed of heat-insulating materials.

24. The refrigerator of claim 22, wherein the drawer comprises a front portion configured to cover a front of the casing and a storing portion extended from the front portion and configured to store food therein, and wherein a height of the storing portion is less than a height of the front portion.

25. A refrigerator, comprising:

a refrigerator main body having a freezing chamber and a chilling chamber in which foods are stored;

a machine room in which a compressor is installed;

a rear path in which cool air generated in an evaporator flows into the freezing chamber and the chilling chamber and flows back to the evaporator;

doors respectively combined with the refrigerator main body and configured to open and close the freezing chamber and the chilling chamber;

a variable temperature storage formed in the chilling chamber;

a heating room formed on a side of the variable temperature storage;

a heating device installed in the heating room and configured to generate heat;

a first local circulating path through which cool air in the freezing chamber flows into the rear path through the variable temperature storage;

an adjusting device configured to adjust a quantity of cool air flowing into/out of the variable temperature storage through the first local circulating path;

a second local circulating path in which air heated in the heating room passes through the variable temperature storage and flows into the heating room again;

a temperature sensor configured to sense a temperature in the variable temperature storage; and a washing device configured to wash vegetables or fruits installed in the variable temperature storage.

26. The refrigerator of claim 25, wherein the washing device comprises:

a water supply pipe configured to supply washing water to the variable temperature storage;

a water supply valve installed on the water supply pipe and configured to adjust a supply of washing water;

a drainage pipe connected to the variable temperature storage and configured to drain washing water;

a drainage valve installed on the drainage pipe and configured to adjust drainage; and a vibration generator configured to vibrate washing water contained in the variable temperature storage.

27. The refrigerator of claim 26, further comprising a drainage pump installed on the drainage pipe.

* * * * *